United States Patent [19]

Lydell

[11] Patent Number: 4,475,495

[45] Date of Patent: Oct. 9, 1984

[54] TRANSMISSION

[76] Inventor: Martin G. Lydell, R.D. #1, Wiegren Rd., Frewsburg, N.Y. 14738

[21] Appl. No.: 424,489

[22] Filed: Sep. 27, 1982

[51] Int. Cl.[3] ..... F02B 75/32

[52] U.S. Cl. ..... 123/197 AB; 123/197 R; 123/197 C; 74/695; 74/713

[58] Field of Search ..... 123/48 R, 48 B, 54 R, 123/54 A, 54 B, 78 R, 78 E, 78 F, 78 BA, 197 R, 197 AB, 197 AC, 197 C; 74/695, 792, 713

[56] References Cited

U.S. PATENT DOCUMENTS

| | | | |
|---|---|---|---|
| 2,380,778 | 3/1944 | Murdock | 123/197 C |
| 2,724,290 | 11/1955 | Gerst | 74/792 |
| 2,909,163 | 10/1959 | Biermann | 123/48 B |
| 3,304,923 | 9/1964 | Parenti | 123/51 R |
| 3,478,622 | 11/1969 | Reid | 74/792 |
| 3,614,902 | 6/1970 | Candellero | 74/695 |
| 4,346,677 | 8/1982 | Nye | 123/54 B |

*Primary Examiner*—Craig R. Feinberg
*Assistant Examiner*—David A. Okonsky
*Attorney, Agent, or Firm*—Bean, Kauffman & Bean

[57] ABSTRACT

An infinitely variable ratio transmission is disclosed in which the rotary output of the crank shaft of an internal combustion engine is imparted to an output or drive shaft in a stepwise manner via an adjustable speed drive linkage and Sprague clutch arrangement coupled to the crank and output shafts. The output shaft is in turn coupled to the wheels of a vehicle via a direction change or forward/reverse mechanism and gear/differential assembly. Operation of the adjustable speed drive linkage may be controlled by a microprocessor system, which is programmed to control overall engine/transmission operation in a manner promoting maximum fuel efficiency.

7 Claims, 6 Drawing Figures

Fig. 1.
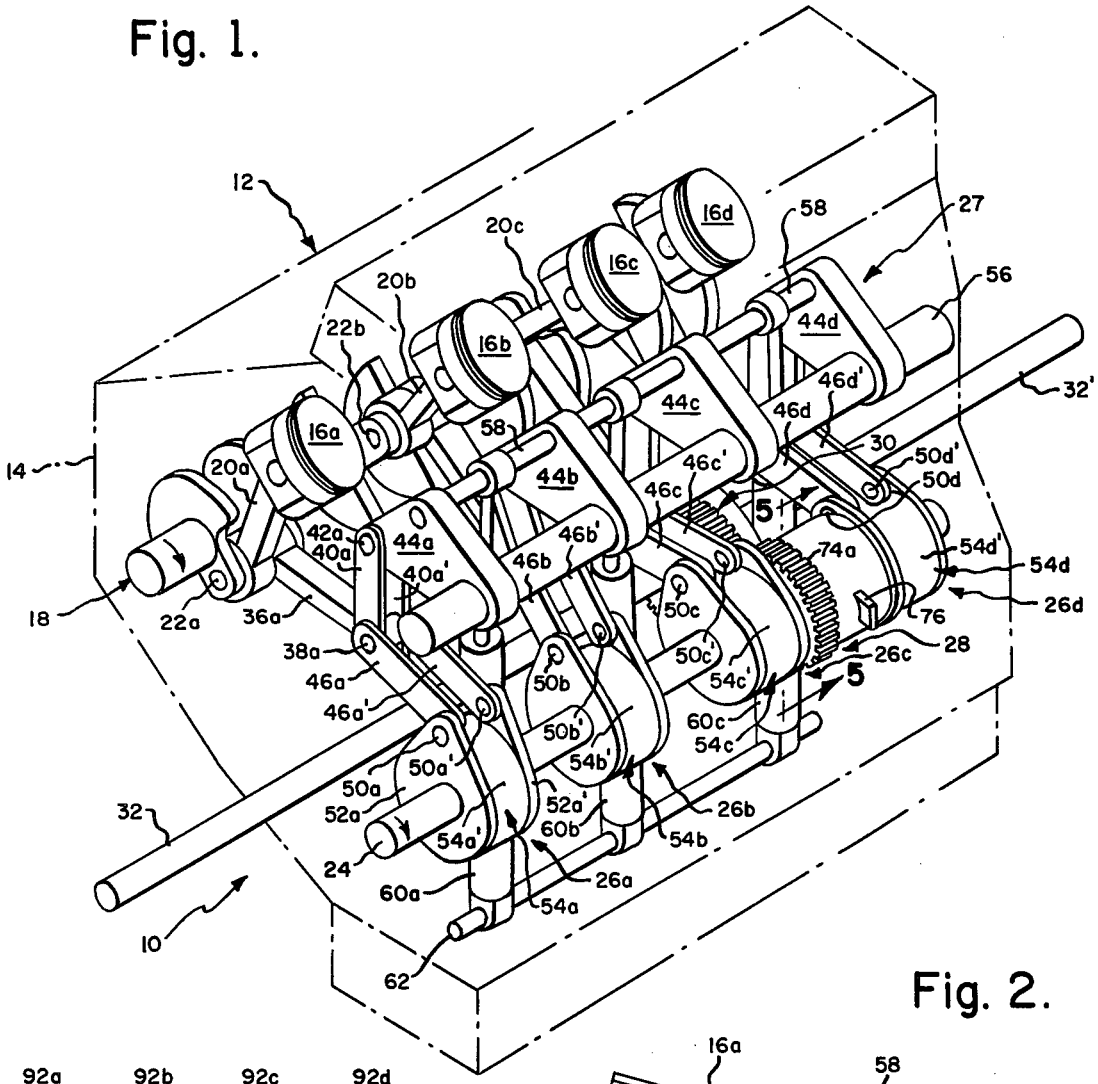
Fig. 2.
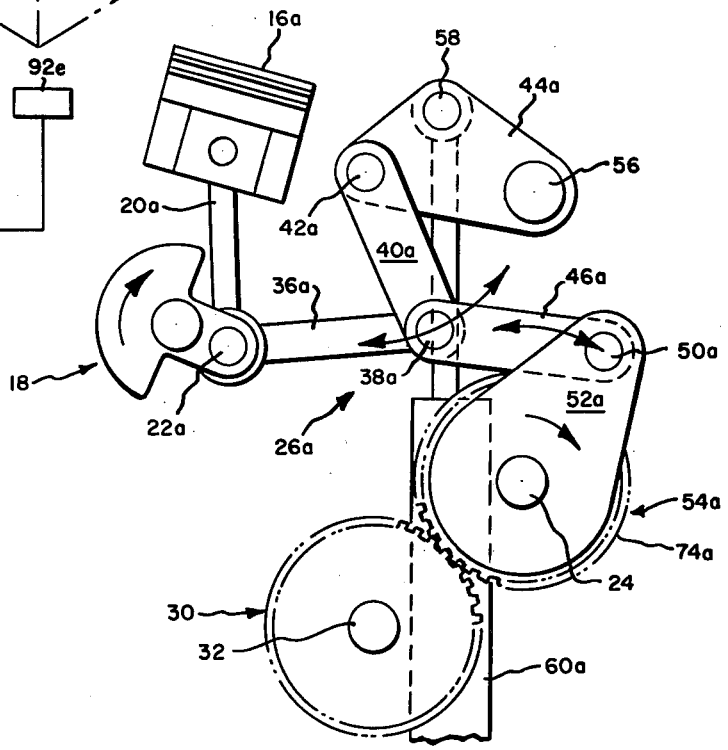
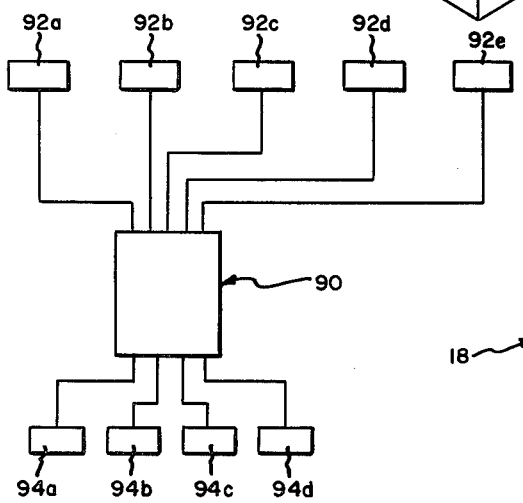
Fig. 6.

Fig. 3.
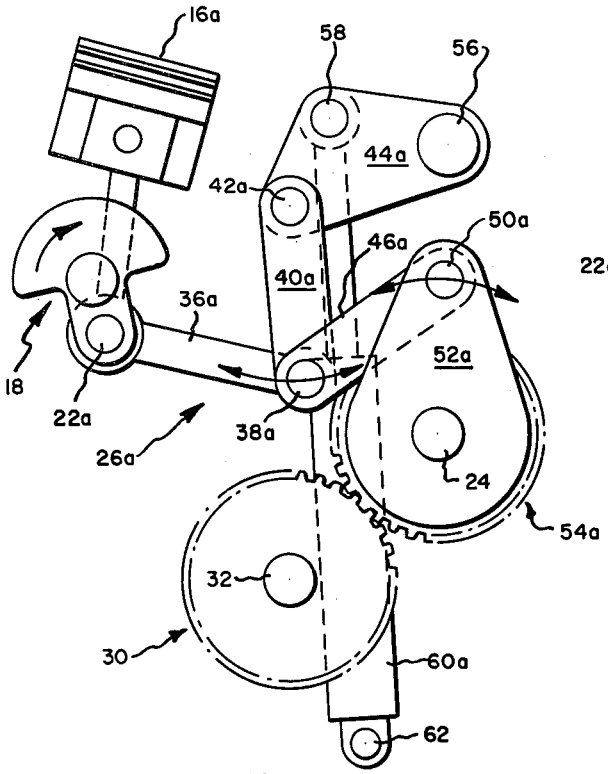
Fig. 4.
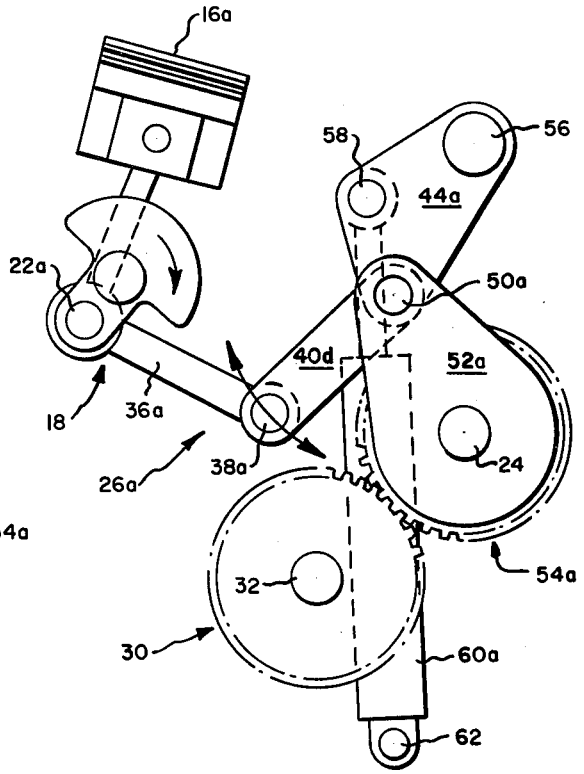
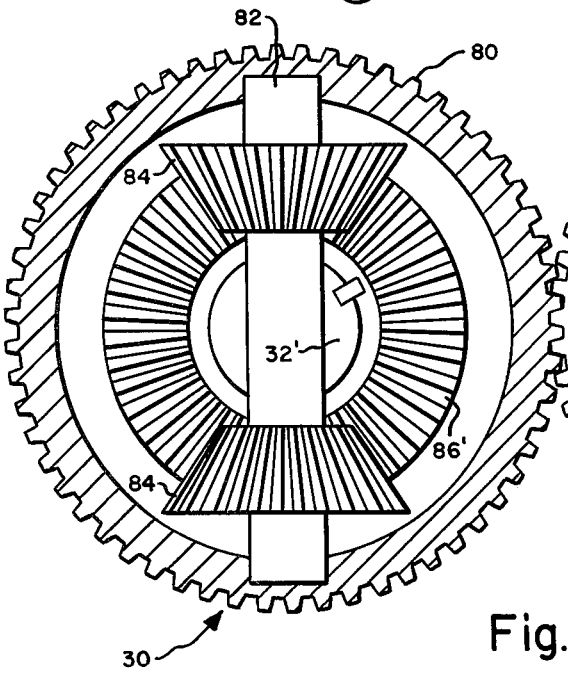
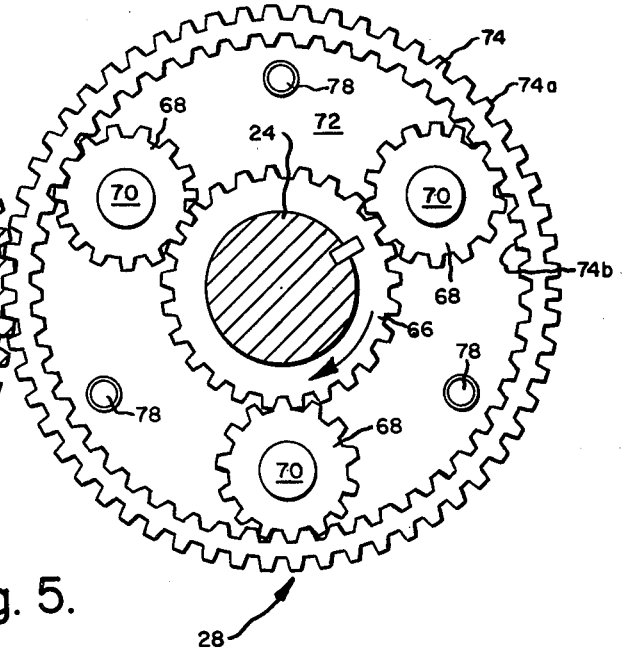
Fig. 5.

TRANSMISSION

BACKGROUND OF THE INVENTION

The present invention relates to an improved transmission particularly adapted for use in motor vehicles.

It is known, as evidenced by U.S. Pat. No. 2,380,778, to provide an internal combustion engine, wherein a series of one-way clutches are employed to transfer power from a crank shaft of the engine to an intermediate shaft, which is in turn coupled to an output or drive shaft. The output shaft would be required in turn to be coupled to a separate transmission in order to adapt the engine for use in a vehicle.

It is also known as evidenced by U.S. Pat. No. 3,304,923 to provide an engine of the type having pairs of opposed pistons arranged to move along arcuate paths disposed concentrically outwardly of a pair of aligned drive shafts, wherein means are employed to adjustably move the pivotal connection between the piston rods and drive shaft affixed arms in a radial direction lengthwise of the arms for purposes of providing for adjustment of the torque transferred to drive shafts. However, the degree of adjustment would appear to be relatively limited and in any event incapable of providing for a null or limiting condition, wherein essentially zero torque is applied to the drive shafts during operation of the engine. As such, this engine would require the provision of a separate transmission in order to adapt it for use in a motor vehicle.

SUMMARY OF THE INVENTION

The present invention is directed to an improved transmission for motor vehicles and more particularly to an infinitely variable transmission adapted to be formed, if desired, as an integral part of a vehicle engine.

In accordance with the present invention rotary motion of an engine crank shaft is transferred to an output shaft disposed parallel to the crank shaft by a plurality of motion transmitting units, which are typically operably associated one with each of the cylinders of the engine and includes one way clutches mounted on the output shaft and coupled to the crank shaft by linkage means providing for infinitely variable speed/torque transfer from the crank shaft to the output shaft between a maximum speed and a minimum speed, such as zero. More specifically, the condition of the linkage means and thus the speed/torque transfer ratio of the transmission is adjusted by a common linkage position control mechanism, which is subject to manual control of a vehicle operator or to automatic control by a microprocessor programmed to provide for maximum fuel efficiency.

A compact engine/transmission installation is provided by coupling the output shaft to the wheels of the vehicle by means of a conventional direction change mechanism mounted on the output shaft and arranged to mesh with a conventional differential from which extends a pair of wheel drive shafts disposed essentially parallel to the output shaft.

DRAWINGS

The nature and mode of operation of the present invention will now be described in the following detailed description taken with the accompanying drawings wherein:

FIG. 1 is a perspective view of an internal combustion engine incorporating a transmission of the present invention;

FIG. 2 is an elevational view of the engine, as viewed in FIG. 1 from the left hand end thereof, showing the transmission in maximum motion transfer condition;

FIG. 3 is a view similar to FIG. 2, but showing the transmission in an intermediate motion transfer condition;

FIG. 4 is a view similar to FIGS. 1 and 2, but showing the transmission in a minimum motion transfer condition;

FIG. 5 is a sectional view taken generally along the line 5—5 in FIG. 1; and FIG. 6 is a diagrammatic view of a microprocessor employed to control operation of the transmission with its associated input and output connections.

DETAILED DESCRIPTION

Reference is first made to FIG. 1, wherein a transmission formed in accordance with the present invention is generally designated as 10 and shown as comprising part of an otherwise conventional internal combustion engine generally designated as 12. To facilitate understanding of the present invention, engine 12 will be disclosed as being an inline, four cycle, four cylinder gasoline engine having in part a casing 14, provided with cylinders, not shown, for receiving pistons **16*a*–16*d*; and a crank shaft 18 coupled to pistons 16*a*–16*c* via piston rods, only three of which are shown at 20*a*, 20*b* and 20*c*, and crank pins, only two of which are shown at 22*a* and 22*b*. Any suitable means, not shown, may be associated with crank shaft 18** for engine starting purposes.

As will be apparent from viewing FIG. 1, the mode of operation of engine 12 may be conventional in that its cylinders fire is some given sequence, such as 1, 2, 4, 3, and in an approximately 90° out of phase relationship, such that the engine is in balance and power is supplied to crank shaft 18 essentially continuously throughout each complete rotational cycle thereof. It will be understood, however, that the present invention is not limited by the type of engine illustrated in FIG. 1, so long as same includes a suitable crank shaft to which driven rotation is imparted in a relatively uniform manner.

Now making reference to FIGS. 1–4, it will be understood that transmission 10 generally comprises a suitably journalled output or drive shaft 24, which is disposed parallel to the axis of rotation of crank shaft 18; a plurality of motion transmitting or drive units, e.g. units **26*a*–26*d*, which preferably correspond in number and are operably associated one with each of the engine pistons, e.g. pistons 16*a*–16*d*, for adjustably controlling speed/torque transfer between crank shaft 18 and output shaft 24; a common control mechanism 27 for controlling operation of units 26*a*–26*d*; and suitable means for coupling output shaft 24 to the drive wheels of a vehicle, not shown, such as may be defined by a conventional forward and reverse or direction change mechanism 28 and a conventional differential assembly 30 coupled with a pair of suitably journalled and axially aligned wheel drive shafts or axles 32 and 32'. Crank shaft 18 and output shaft 24 may be journalled for rotation within engine casing 14** by any suitable means, not shown.

Preferably, motion transmitting units are of like construction and thus only unit **26*a* depicted in FIGS. 1–4** will be specifically described, with like parts of units 26b, 26c and 26d being designated in FIG. 1 by like numerals bearing appropriate suffixes "b", "c" and "d", respectively. More specifically, reference is made to FIGS. 1–4, wherein unit 26a is shown as including a linkage comprising a connecting rod 36a having a first end journalled on crank pin 22a and a second end carrying a first pivot pin 38a; and at least one and preferably a pair of drive links 46a and 46a' having first ends journalled on first pivot pin 38a and second ends journalled on a pair of axially aligned second pivot pins 50a and 50a' carried by parallel drive arms 52a and 52a' forming a part of and the drive input to a conventional one-way or Sprague clutch 54a carried by output shaft 24.

Common control mechanism 27 includes in part at least one and preferably a pair of parallel control links provided one pair in association with the linkage of each of units 26a–26d, but which are only specifically identified for the case of unit 26a as 40a and 40a'. It will be understood by reference to FIGS. 1 and 2 that control links 40a and 40a' have first ends journalled on first pivot pin 38a axially intermediate connecting rod 36a and drive links 46a and 46a', and second ends journalled on a third pivot pin 42a carried by an associated control arm 44a. Preferably, control links 40a and 40a' have a length corresponding to drive links 46a and 46a', such that pivot pin 42a may be disposed in essential axial alignment with pivot pins 50a and 50a', when the linkage is moved into its limiting position to be described with reference to FIG. 4.

Control mechanism is shown in FIG. 1 as additionally including a stationary, engine casing mounted common first support shaft 56, which is disposed parallel to drive shaft 24 and serves to rotatably support control arms 44a–44d in a spaced parallel relationship and for pivotal movement about a common axis; a common control shaft 58 for coupling control arms 44a–44d to one another and for conjunctive pivotal movements about the axis of support shaft 56; and a common operator or control device, such as may be defined by at least one and preferably three hydraulic cylinders 60a–60c, which have the lower ends of their cylinder housings journalled on a stationary, common second support shaft 62 or directly to engine casing 14 and the free ends of their piston rods journalled on control shaft 58. If desired, a suitable mechanical operator, such as a push-pull rod, or a suitable electrical operator, such as an electrically powered stepping motor, may be employed in place of cylinders 60a–60c.

One way clutches 54a–54d may be of any desired or commercially available construction, but typically would include inner parts, not shown, non-rotatably fixed to output shaft 24 and concentrically arranged outer parts 54a'–54d', which are fixed for rotation with their associated drive arms 52a and 52a'–52d and 52d'; and spring biased coupling rollers or balls, not shown, fitted within tapered slots or cam recesses, also not shown, defined by facing surfaces of the inner and outer parts, such that the inner part and thus shaft 24 is coupled to the outer part for driven rotational movement only in one direction. For purposes of illustration, units 26a–26d and clutches 54a–54d are shown as being arranged in a manner permitting clockwise rotations to be imparted to shaft 24, as an incident to clockwise directed rotations of crank shaft 18, but it will of course be understood that the direction of rotation imparted to the output shaft is a matter of choice and dependent on the orientation of the clutches relative thereto.

Direction change mechanism 28 is best shown in FIG. 5 as including a shaft gear 66, which is suitably keyed to output shaft 24; a plurality of sun gears 68, which are rotatably supported by pins 70 rigidly fixed to a plate 72; a ring gear 74 having inner and outer teeth 74b and 74a; a stationary reaction housing 76 shown only in FIG. 1; and suitable means including a plurality of coupling pins 78, which are axially displaceable for selectively coupling plate 72 alternatively to a flange, not shown, forming an integral part of ring gear 74 or to housing 76. As will be apparent from viewing FIG. 5, sun gears 68 are arranged to mesh with shaft gear 66 and the inner teeth 74b of ring gear 74. Thus, when pins 78 are positioned to couple plate 72 to ring gear 74, but not housing 76, the ring gear is locked for rotation with drive shaft 24 to establish the forward drive condition of mechanism 28. When pins 78 are displaced to couple plate 72 to housing 76, but not ring gear 74, plate 72 is maintained stationary and ring gear 74 is caused to rotate in a direction opposite to that of output shaft 24 and at a reduced speed to establish the reverse drive condition of mechanism 28. Any suitable means, not shown, may be employed to effect displacements of pins 78 under the control of the vehicle operator.

By again making reference to FIG. 5, it will be understood that differential assembly 30 is of conventional construction in that it includes an outer or driven gear 80 arranged to mesh with the outer teeth 74a of ring gear 74; a spider pin 82, which is carried for rotation with gear 80 and in turn serves to support a pair of spider or bevel gears 84 and 84 for rotation about an axis extending lengthwise of the spider pin; a pair of bevel gears, only one of which is shown at 86', arranged to mesh with spider gears 84 and 84 and fixed for rotation with wheel drive shafts 32 and 32', respectively. Under normal driving conditions, wheel drive shafts 32 and 32' rotate with driven gear 80, but when rotation of one or the other of such shafts is retarded, assembly 30 provides for a required difference in rotational speed between the wheel drive shafts.

Reference is now made to FIG. 2, wherein unit 26a is shown as being disposed essentially in its full speed transfer condition, wherein control arm 44a is arranged in a first limiting pivotal position thereof providing for a maximum angular displacement or oscillation of clutch drive arms 52a and 52a' relative to the axis of output shaft 24 incident to each full rotational cycle of crank shaft 18. Specifically, it will be understood from viewing FIG. 2, that in this pivotal position of control arm 44a, drive links 46a and 46a' are caused to undergo lengthwise displacements, which are essentially reciprocating in nature, such that third pivot pins 50a and 50a' are caused to undergo a maximum arcuate displacement in a counterclockwise direction from their illustrated positions incident to a rotation of crank shaft 18 in a clockwise direction through approximately 180° from its illustrated position. During this initial half of the operational cycle of unit 26a, clutch 54a is disengaged and does not serve to impart driven rotational movement to output shaft 24. Upon continued rotation of crank shaft 18 in a clockwise direction through 180° for return to its illustrated position to complete a cycle of rotation thereof, pivot pins 50a and 50a' caused to undergo a corresponding maximum arcuate displacement in a clockwise direction for return to their illustrated position. During this final half of the operational cycle of unit 26a, clutch 54a is engaged and thus serves to impart driven rotational movement to output shaft 24.

Reference is now made to FIG. 4, wherein unit 26*a* is shown as being disposed essentially in its minimum speed transfer or idle condition, wherein control arm 44*a* is arranged in a second limiting pivotal position thereof providing for a minimum, and preferably zero, angular displacement or oscillation of clutch 54*a* relative to the axis of drive shaft 24 incident to each full rotational cycle of crank shaft 18. In this condition of unit 26*a*, drive links 46*a* and 46*a'* are disposed in essential alignment with control links 40*a* and 40*a'* and third pivot pins 50*a* and 50*a'* are disposed in essential axial alignment with second pivot pin 42*a*. Thus, drive links 46*a* and 46*a'* are caused to undergo pivotal movements about the axis of pivot pins 50*a* and 50*a'*, which is preferably not accompanied with any lengthwise displacements of the drive links, such as would cause arcuate displacements of pivot pins 50*a* and 50*a'* incident to rotation of crank shaft 18. Thus, in this limiting position, the drive connection between crank shaft 18 and output shaft 24 may, if desired, be wholly interrupted, and the output shaft permitted to remain at rest or rotate at a speed independent of the rotational speed of the crank shaft.

In FIG. 3, unit 26*a* is shown as being disposed in an intermediate speed or torque transfer condition, wherein control arm 44*a* is arranged in an adjustably selected pivotal position intermediate its limiting pivotal positions of FIGS. 2 and 4. In this condition of unit 26*a*, drive links 46*a* and 46*a'* undergo both lengthwise displacements and pivotal movements about pivot pins 50*a* and 50*a'*, but not to the extent to which this occurs when the unit is in maximum and minimum speed transfer conditions depicted in FIGS. 2 and 4, respectively. As a result, pivot pins 50*a* and 50*a'* are caused to be displaced back and forth along an arcuate path whose length is intermediate that corresponding to the maximum and minimum condition discussed with reference to FIGS. 2 and 4, whereby to impart driven rotational movement to output shaft 24 at a speed intermediate maximum and minimum or zero speeds.

Although the operation of only unit 26*a* has been described in detail, it will be understood that the mode of operation of units 26*b*–26*d* is identical thereto in that control arms 44*a*–44*d* occupy the same pivotal or control position for each speed transfer conditions of the common control mechanism. During each rotational cycle of crank shaft 18, units 26*a*–26*b* are operated in a sequence determined by the firing sequence of the cylinders of engine 12, e.g. 26*a*, 26*b*, 26*d* and 26*c*, and in an approximately 90° out of phase relationship. Thus, in the illustrated arrangement, four driving pulses are imparted to output shaft 24 during each complete rotational cycle of crank shaft 18 for all speed transfer conditions of the common control mechanism, with the possible exception of its minimum speed transfer condition; the arcuate portions of the rotational cycle of the output shaft through which such pulses are applied being equal for any given speed transfer condition, but varying in a progressively decreasing manner, as control arms 44*a*–44*d* are simultaneously pivoted in a counterclockwise direction from their first limiting position described with reference to FIG. 2 towards their second limiting position described with reference to FIG. 4. Therefore, the present invention permits output shaft 24 to be driven at essentially any desired speed limited only by the speed of engine 12 and the setting of the speed transfer condition of the common control mechanism.

The setting of the speed transfer condition of the common control mechanism may be subject to simple manual control by a vehicle operator by use of any conventional means dependent upon whether the common control mechanism employs fluid, mechanical or electrical control elements. However, the present invention would preferably be practiced in combination with a microprocessor generally designated as 90 in FIG. 6 intended to coordinate vehicle operating parameters with a view towards obtaining maximum fuel efficiency under various vehicle operating conditions. For example, microprocessors may be provided with five informational signal inputs, including vehicle speed 92*a*, engine RPM 92*b*, gallons per minute consumed by the engine 92*c*, the speed transfer condition of the common control mechanism 92*d*, and setting or position of the engine throttle or accelerator pedal 92*e*; and four signal outputs, including a control signal 94*a* for effecting adjustment of the setting of the engine throttle or accelerator pedal, a control signal 94*b* for effecting adjustment of the speed transfer condition of the common control mechanism, an informational signal 94*c* for use in providing the vehicle operator with instantaneous readings of miles per gallon achieved during vehicle operation and an informational signal 94*d* for use in providing the operator with instantaneous driving efficiency. Assuming microprocessor 90 has been programmed to provide fuel efficiency at all times, a change in an input signal, such as engine throttle setting occurring as an incident to depression of the accelerator pedal when the operator desires to increase vehicle speed, serves in a manner dependent upon the condition of the other signals 92*a*, 92*b*, 92*c*, and 92*d* to vary control signal 94*b*. As in the case of a conventional automatic transmission, however, microprocessor 90 will normally serve to increase the torque and decrease the speed applied to output shaft 24 while the vehicle is operated under low speed or high load conditions, whereas the opposite is true under high speed or low load conditions.

The specific construction of microprocessor 90 does not form part of the present invention in that it is contemplated that any commercially available microprocessor may be used so long as same is programmable in the manner generally indicated above. Moreover, the program which may be employed is to some degree a matter of choice and determined to a great extent on a trial and error basis. In a like manner, various commercially available devices will satisfactorily serve to provide input signals to and be responsive to output signals from the microprocessor. Thus, it is intended that the present invention be directed to the transmission described in detail above, whether same is controlled directly by a vehicle operator or with the assistance of a suitable microprocessor.

What is claimed is:

1. In an internal combustion engine having a series of power cylinder containing pistons therewithin; a crankshaft having cranks coupled to said pistons by piston connection rods; an infinitely variable transmission for transferring rotary motion of said crankshaft to an output shaft disposed essentially parallel to said crank shaft and connected in turn to a vehicle wheel drive means, said transmission comprising in combination:

a plurality of motion transmitting units operably associated one with each of the cylinders of said engine, each of said units including a one-way clutch mounted on said output shaft and a linkage having opposite ends thereof pivotally coupled to said crank shaft and said clutch; and a common linkage position control mechanism for simultaneously moving each said linkage between first and second limiting pivotal positions providing for maximum and minimum oscillations of each said clutch about the axis of said output shaft during rotation of said crank shaft, wherein each said linkage includes a connecting rod having a first end pivotally connected to said crank shaft and a second end, and at least one drive link having a first end pivotally connected to said second end of said connecting rod by a first pivot pin and a second end pivotally coupled to said one-way clutch by a second pivot pin; and said control mechanism includes at least one control link and control arm for each said linkage and common control means for each said control arm, said control link having a first end pivotally coupled to said connecting rod and said drive link by said first pivot pin and a second end pivotally coupled to said control arm by a third pivot pin, said control arm is pivotally supported and said common control means effects pivotal movement of each said control arm to move each said third pivot pin between a first position corresponding to said first limiting pivotal position and a second position corresponding to said second pivotal position.

2. A transmission according to claim 1, wherein each said clutch is subject to essentially no oscillation when each said linkage is in said second position.

3. A transmission according to claim 1, wherein said third pivot pin when in said second position thereof is disposed essentially in axial alignment with said second pivot pin.

4. A transmission according to claim 3, wherein said common control means includes hydraulic cylinder means.

5. The combination of an internal combustion engine for a wheeled vehicle including a casing, a plurality of cylinders, a plurality of pistons associated one with each of said cylinders, a crank shaft rotatably supported by said casing and operably coupled to said pistons by piston rods and crank pins, and means for transferring rotary movement of said crank shaft to vehicle wheel drive shafts, said means including a transmission coupled to said crank shaft, a direction change mechanism coupled to said transmission, and a differential coupled to said direction change mechanism, said wheel drive shafts are coupled to said differential, said transmission including an output shaft rotatably supported by said casing and having an axis disposed parallel to said crank shaft, a plurality of motion transmitting units operably associated one with each of said pistons, each of said units including a one-way clutch mounted on said output shaft and a linkage having opposite ends pivotally connected to said crank shaft by a crank pin of its associated piston and to said clutch, wherein each said linkage includes a connecting rod having a first end pivotally connected to said crank pin and at least one drive link having a first end thereof pivotally connected to a second end of said connecting rod by a first pivot pin and a second end thereof pivotally connected to said clutch by a second pivot pin, and a common linkage piston control mechanism mounted on said casing for simultaneously moving each said linkage between first and second limiting pivotal positions providing for maximum and minimum oscillations of each said clutch about said axis of said output shaft during rotation of said crank shaft, wherein said control mechanism includes at least one control link and control arm for each said linkage and common control means for each said control arm, said control link having a first end pivotally connected to said connecting rod and said drive link by said first pivot pin and a second end pivotally connected to said control arm by a third pivot pin, and said control means includes a common shaft supported by said casing and having an axis arranged parallel to said output shaft, said common shaft pivotally supporting each said control arm, and means for effecting simultaneously pivotal movements of each said control arm about said axis of said common shaft to move each said third pivot pin between a first position corresponding to said first limiting pivotal position and a second position corresponding to said second pivotal position.

6. The combination of claim 5, wherein said third pivot pin when in said second position thereof is disposed essentially in axial alignment with said second pivot pin.

7. The combination of claim 5, wherein said direction change mechanism is mounted on said output shaft intermediate ends thereof and includes a ring gear drivingly coupled to said output shaft and subject to driven rotations in opposite directions, said differential includes an outer gear arranged in meshing engagement with said ring gear, said wheel drive shafts are a pair of shafts arranged parallel to said output shaft and have adjacent ends thereof drivingly coupled to said outer gear.

* * * * *